US010360749B2

(12) United States Patent
Park et al.

(10) Patent No.: US 10,360,749 B2
(45) Date of Patent: Jul. 23, 2019

(54) BILL SEPARATING AND STACKING UNIT

(71) Applicant: HYOSUNG TNS INC., Seoul (KR)

(72) Inventors: Jong Seong Park, Anyang-si (KR); Chang Ho Park, Gunpo-si (KR); Soon Ho Choi, Suwon-si (KR)

(73) Assignee: HYOSUNG TNS INC., Seoul (KR)

( * ) Notice: Subject to any disclaimer, the term of this patent is extended or adjusted under 35 U.S.C. 154(b) by 0 days.

(21) Appl. No.: 15/934,723

(22) Filed: Mar. 23, 2018

(65) Prior Publication Data

US 2018/0286165 A1 Oct. 4, 2018

(30) Foreign Application Priority Data

Mar. 31, 2017 (KR) ..... 10-2017-0041986

(51) Int. Cl.

| | |
|---|---|
| ***B65H 31/06*** | (2006.01) |
| ***G07D 11/16*** | (2019.01) |
| ***G07D 11/50*** | (2019.01) |
| ***B65H 31/12*** | (2006.01) |
| ***B65H 31/18*** | (2006.01) |
| ***B65H 83/02*** | (2006.01) |

(Continued)

(52) U.S. Cl.

CPC ..... *G07D 11/16* (2019.01); *B65H 29/46* (2013.01); *B65H 31/06* (2013.01); *B65H 31/12* (2013.01); *B65H 31/18* (2013.01); *B65H 83/02* (2013.01); *B65H 83/025* (2013.01); *G07D 11/50* (2019.01); *B65H 2404/1114* (2013.01); *B65H 2701/1912* (2013.01); *G07F 19/202* (2013.01); *G07F 19/203* (2013.01)

(58) Field of Classification Search

CPC ..... B65H 31/18; B65H 83/02; B65H 83/025; B65H 31/12; B65H 31/06; B65H 2404/1114

See application file for complete search history.

(56) References Cited

U.S. PATENT DOCUMENTS 7,677,545 B2 * 3/2010 Iwami ..... B65H 1/025 271/153
2003/0047601 A1 * 3/2003 Nomiyama ..... G07F 19/20 235/381

(Continued)

*Primary Examiner* — Howard J Sanders
(74) *Attorney, Agent, or Firm* — Fenwick & West LLP

(57) ABSTRACT

The present invention is directed to providing a bill-separating-and-stacking unit with a simplified power-transmission structure by integrating driving units of a push plate and a shutter into a single unit. The bill-separating-and-stacking unit includes a sheet roller configured hit bills entering a bill-stacking space with a sheet, which is rotated, and configured to guide the bills to be stacked, a push plate configured to perform reciprocation and support the bills which are stacked in the bill-stacking space, a shutter which is rotated in one direction to be located in a stacking position so that the sheet of the sheet roller is rotatable to an upper side of the bill-stacking space when the bills are stacked, and is rotated in a direction opposite the one direction to be located in a separating position so that the sheet is prevented from protruding to the upper side of the bill-stacking space when the bills are separated, and a push-plate-and-shutter driving unit having a single driving source so that the push plate and the shutter are worked in conjunction with each other.

8 Claims, 10 Drawing Sheets

(51) Int. Cl.
*B65H 29/46* (2006.01)
*G07F 19/00* (2006.01)

(56) References Cited

U.S. PATENT DOCUMENTS

| | | | | |
|---|---|---|---|---|
| 2009/0152805 | A1* | 6/2009 | Nomiyama | B65H 1/025 271/227 |
| 2011/0031308 | A1* | 2/2011 | Holland-Letz | B65H 1/025 235/379 |
| 2018/0082507 | A1* | 3/2018 | Park | B65H 31/06 |

* cited by examiner

BILL SEPARATING AND STACKING UNIT

CROSS-REFERENCE TO RELATED APPLICATION

This application claims priority to and the benefit of Republic of Korea Patent Application No. 10-2017-0041986, filed on Mar. 31, 2017, the disclosure of which is incorporated herein by reference in its entirety.

BACKGROUND

1. Field of the Invention

The present invention relates to a bill-separating-and-stacking unit, and more particularly, to a bill-separating-and-stacking unit in which driving units of a push plate and a shutter are integrated into a single unit to simplify a power-transmission structure.

2. Discussion of Related Art

In general, an automated teller machine (ATM) includes a bill-processing device for depositing or withdrawing paper-type medium (hereinafter collectively referred to as a "bill") such as a bill, a check, etc., and the bill-processing device includes a bill-separating-and-stacking unit for storing a bill.

FIG. 1 is a configuration diagram illustrating a bill-separating-and-stacking unit according to the related art.

A conventional bill-separating-and-stacking unit 1 includes a bill-stacking space S in which bills P are stacked, and a separating-and-stacking mechanism 10 is provided at a lower part of the bill-separating-and-stacking unit 1 in order to stack the bills P in the bill-stacking space S or separate and release the bills P stored in the bill-stacking space S.

The separating-and-stacking mechanism 10 may include a pickup roller 11 for separating each bill P, a feed roller 12 which is provided under the pickup roller 11 and applies transmission power to the bills P, a guide roller 13 which is circumscribed about the feed roller 12 and prevents the bills P from being separated in two bills, and a sheet roller 15 which is provided at a rotating shaft 14 that is the same as that of the guide roller 13 and to which a plurality of sheets 15*a* with elasticity are radially attached to hit a rear end of the stacked bills.

In an upper part of the separating-and-stacking mechanism 10 on one side of the bill-separating-and-stacking unit 1, a plate 20, which is obliquely disposed, is provided to guide the bills P hit by the sheets 15*a* of the sheet roller 15 while passing the separating-and-stacking mechanism 10 to the bill-stacking space S.

A push plate 30 which performs reciprocation and supports the bills P stacked in the bill-stacking space S is provided inside the bill-separating-and-stacking unit 1.

A guide unit 40 which is connected to a bottom surface of the bill-stacking space S, and through which the sheets 15*a* of the sheet roller 15 pass, is provided at an upper part and one lateral part of the sheet roller 15.

A shutter 50 is provided under the guide unit 40. The shutter 50 is rotated in one direction (a clockwise direction in the drawing) about a shutter shaft 51 to be located in a stacking position as shown in a dashed line so that the sheets 15*a* of the sheet roller 15 are rotatable to an upper side of the bill-stacking space S when the bills P are stacked, and the shutter is rotated in a reverse direction (a counterclockwise direction in the drawing) about the shutter shaft 51 to be located in a separating position as shown in a solid line so that the sheets 15*a* are prevented from protruding to the upper side of the bill-stacking space S when the bills P are separated.

There has been a problem in that the conventional bill-separating-and-stacking unit has a complex power-transmission structure based on separated driving units of the push plate and the shutter because a driving unit for providing power for reciprocation of the push plate 30 and a driving unit for providing power for rotation of the shutter 50 are independently provided.

Prior art associated with such a bill-separating-and-stacking unit using a sheet roller is disclosed in the Korean Patent Nos. 10-1218014 and 10-1607339.

SUMMARY OF THE INVENTION

Accordingly, the present invention is directed to providing a bill-separating-and-stacking unit with a simplified power-transmission structure by integrating driving units of a push plate and a shutter into a single unit.

One aspect of the present invention provides a bill-separating-and-stacking unit including: a sheet roller configured to hit bills entering a bill-stacking space with a sheet, which is rotated, and configured to guide the bills to be stacked; a push plate configured to perform reciprocation and support the bills which are stacked in the bill-stacking space; a shutter which is rotated in one direction to be located in a stacking position so that the sheet of the sheet roller is rotatable to an upper side of the bill-stacking space when the bills are stacked, and is rotated in a direction opposite the one direction to be located in a separating position so that the sheet is prevented from protruding to the upper side of the bill-stacking space when the bills are separated; and a push-plate-and-shutter driving unit having a single driving source such that the push plate is worked in conjunction with the shutter.

The push-plate-and-shutter driving unit may include a driving motor, a first belt which is rotated and driven by the driving motor and is connected to the push plate, and a second belt which is rotated in conjunction with the first belt and is connected to the shutter.

The bill-separating-and-stacking unit may further include a first rotation-restriction mechanism in which the shutter is rotated to be stopped at the stacking position when the bills are stacked, and a second rotation-restriction mechanism in which the shutter is rotated to be stopped at the separating position when the bills are separated.

The first rotation-restriction mechanism may include a protrusion formed on one side of the shutter, and a latch by which the shutter is engaged with the protrusion and stopped when the shutter is rotated to the stacking position.

The bill-separating-and-stacking unit may further include a guide unit which is connected to a bottom surface of the bill-stacking space and in which a cutout part through which the sheets of the sheet roller pass is formed, and the second rotation-restriction mechanism may include a rib which is formed on the shutter to obstruct the cutout part when the bills are separated, and one lateral part of the cutout part with which the rib is engaged when the bills are separated.

The bill-separating-and-stacking unit may further include a torque limiter configured to block power of the first belt from being transmitted to the second belt when the shutter is rotated to the stacking position and is stopped by the first rotation-restriction mechanism or when the shutter is rotated to the separating position and is stopped by the second rotation-restriction mechanism.

The bill-separating-and-stacking unit may further include a power-transmission belt configured to transmit power between the first belt and the second belt.

The bill-separating-and-stacking unit may further include a separating-and-stacking-mechanism driving unit configured to drive a separating-and-stacking mechanism, wherein the separating-and-stacking mechanism in which bills returned along a returning path are stacked in the bill-stacking space or the bills stored in the bill-stacking space are separated and returned is provided at a bill inlet side of the bill-stacking space, and the separating-and-stacking mechanism may include a pickup roller configured to separate each bill stored in the bill-stacking space, a feed roller which is provided under the pickup roller and applies transmission power to the bills, a guide roller which is circumscribed about the feed roller and prevents the bills from being separated in two bills, and a sheet roller.

The separating-and-stacking-mechanism driving unit may include a driving motor, and a plurality of gears which are rotated by the driving motor and are gear-coupled to each other such that a pickup roller shaft coupled to the pickup roller, a feed roller shaft coupled to the feed roller, a rotating shaft to which the guide roller and the sheet roller are coupled, and a shutter shaft coupled to the shutter are rotated in conjunction with each other.

A pair of gears are mutually gear-coupled at positions spaced apart from each other on both sides of the rotating shaft and the shutter shaft so that the rotating shaft and the shutter shaft are rotated in conjunction with each other, a shutter pulley connected to the second belt is provided on one side of the shutter, and a bearing is interposed between the shutter shaft and the shutter pulley so that the shutter is rotated and driven by driving power of the push-plate-and-shutter driving unit without being influenced by driving power of the separating-and-stacking-mechanism driving unit.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
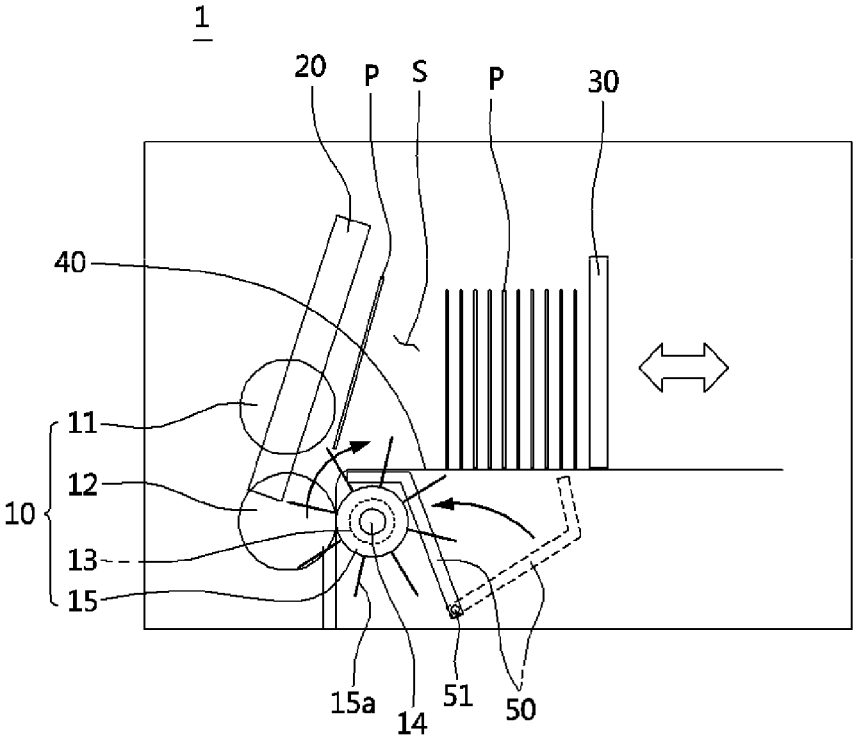
PRIOR ART FIG. 1
FIG. 1 is a configuration view of a bill-separating-and-stacking unit according to the related art.

Hereinafter, a configuration and operations of exemplary embodiments of the present invention will be described in detail with reference to the accompanying drawings.

Referring to FIGS. 2 to 5, a bill-separating-and-stacking unit 1000 according to the present invention includes a bill-stacking space S in which bills P are stored, and a separating-and-stacking mechanism 100 provided at a lower part of one side of the bill-separating-and-stacking unit in order to stack the bills P that are returned along a returning path 160 in the bill-stacking space S or separate and return the bills P which are stored in the bill-stacking space S.

The separating-and-stacking mechanism 100 may include a pickup roller 110 for separating each of the bills P stored in the bill-stacking space S, a feed roller 120 which is provided under the pickup roller 110 and applies transmission power to the bills P, a guide roller 130 which is circumscribed about the feed roller 120 and prevents the bills P from being separated in two bills, and a plurality of sheet rollers 150 which are provided at a rotating shaft 140 that is the same as that of the guide roller 130 and to which a plurality of sheets 151 with elasticity are radially attached. The sheet rollers 150 serve to guide the bills P to be stacked by hitting the bills P entering the bill-stacking space S with the sheets 151 that are rotated.

On one side of the bill-stacking space S, a plate 200 which is obliquely arranged is provided to guide the bills P hit by the sheets 151 of the sheet rollers 150 to the bill-stacking space S.

A plurality of stoppers 210 may be provided at positions spaced apart from each other on both sides of an upper part of the plate 200. The stoppers 210 serve to stop an upward movement of the bills P because an upper end of the bills P that enters the bill-stacking space S after passing the separating-and-stacking mechanism 100 is in contact with the stoppers 210.

The returning path 160 is provided with a bill-detecting unit 170 for detecting whether the bill P is passed. When the bill P is detected to have passed at the bill-detecting unit 170, a signal detected by the bill-detecting unit 170 is transmitted to a controller (not shown), and the controller controls the stoppers 210 to be rotated about a rotating shaft 211 so that the stoppers 210 are moved to a position being in contact with the upper end of the bills P. A driving unit (not shown) is connected to the rotating shaft 211 of the stoppers 210 for transmitting power to rotate the stoppers 210.

A damper 220 for absorbing impact may be provided between the plurality of stoppers 210 such that the damper comes into contact with the upper end of the bills P entering the bill-stacking space S before the upper end of the bills P comes into contact with the stoppers 210. The damper 220 may be inclined upward and protrude from the plate 200 with a predetermined length, and the damper 220 may be connected to an elastic member (not shown) in order to absorb impact when colliding with the bills P.

A push plate 300 which performs reciprocation and supports the bills P stacked in the bill-stacking space S is provided inside the bill-separating-and-stacking unit 1000. The bill-stacking space S is provided between the plate 200 and the push plate 300.

Figure 3:
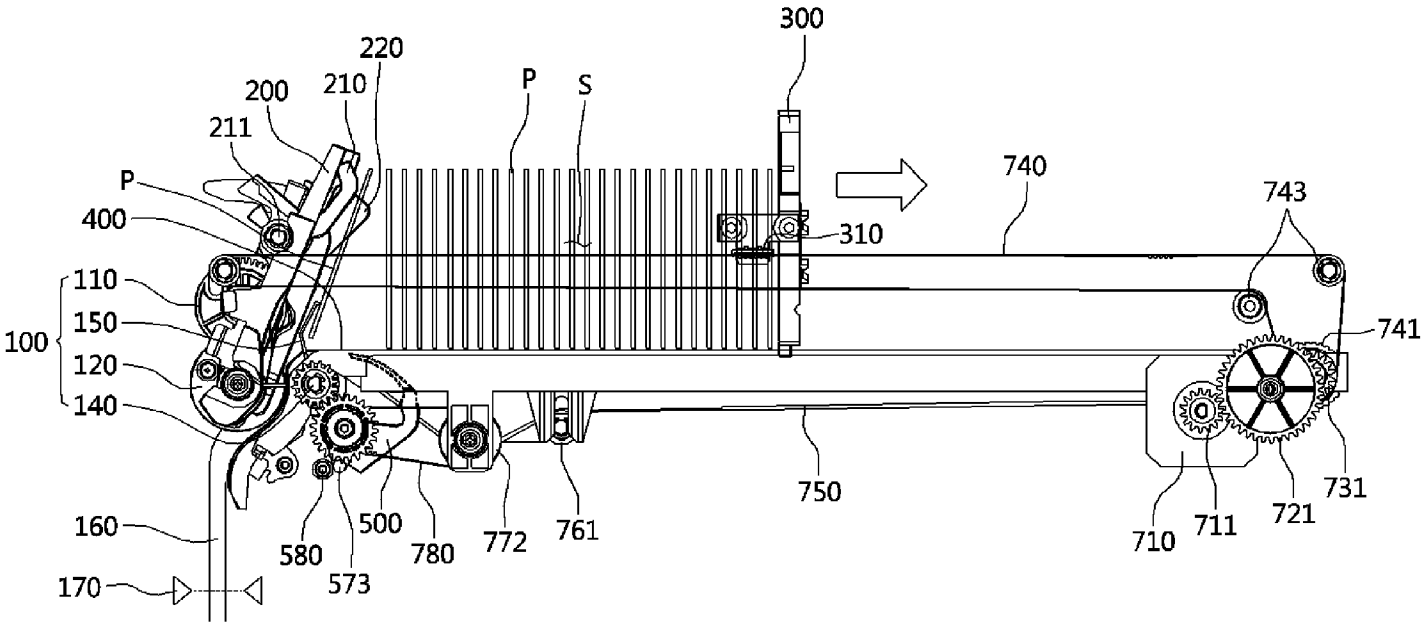
FIG. 3 is a view illustrating an operation status of the bill-separating-and-stacking unit when bills are stacked according to one embodiment of the present invention.
Figure 4:
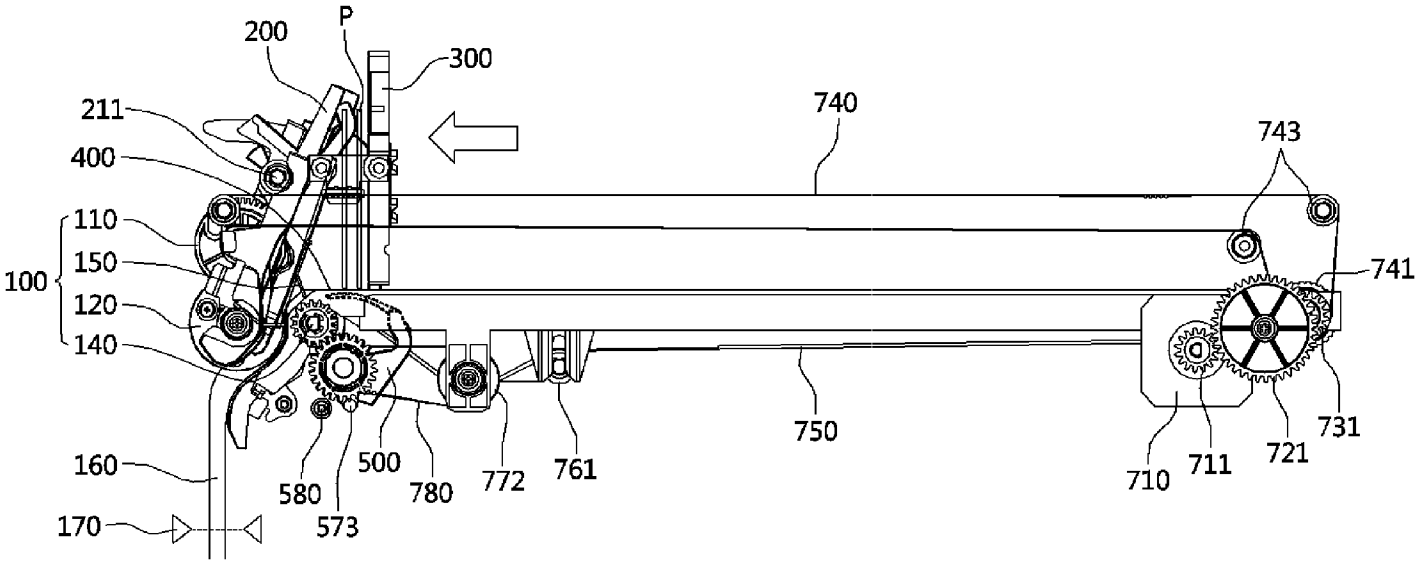
FIG. 4 is a view illustrating an operation status of the bill-separating-and-stacking unit when bills are separated according to one embodiment of the present invention.

FIG. 3 illustrates a status in which the push plate 300 is moved to the right side as the number of bills P stored in the bill-stacking space S increases when the bills P are stacked, and FIG. 4 illustrates a status in which the push plate 300 is moved to the left side when the bills P are separated so as to push the bills stacked in the bill-stacking space S to a side of the pickup roller 110.

Coupling units 310 are provided at both side ends of the push plate 300, and the coupling units 310 are coupled to a first belt 740 which is rotated by driving of a driving motor 710.

Figure 5:
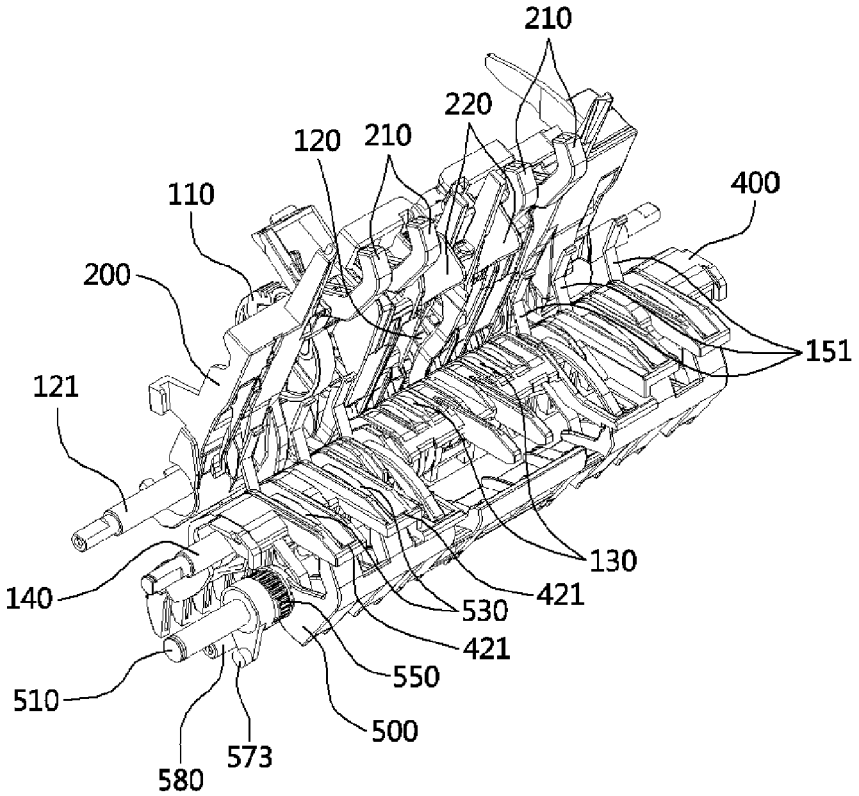
FIG. 5 is a perspective view illustrating a bill inlet side of a bill-stacking space of the bill-separating-and-stacking unit according to one embodiment of the present invention.
Figure 6:
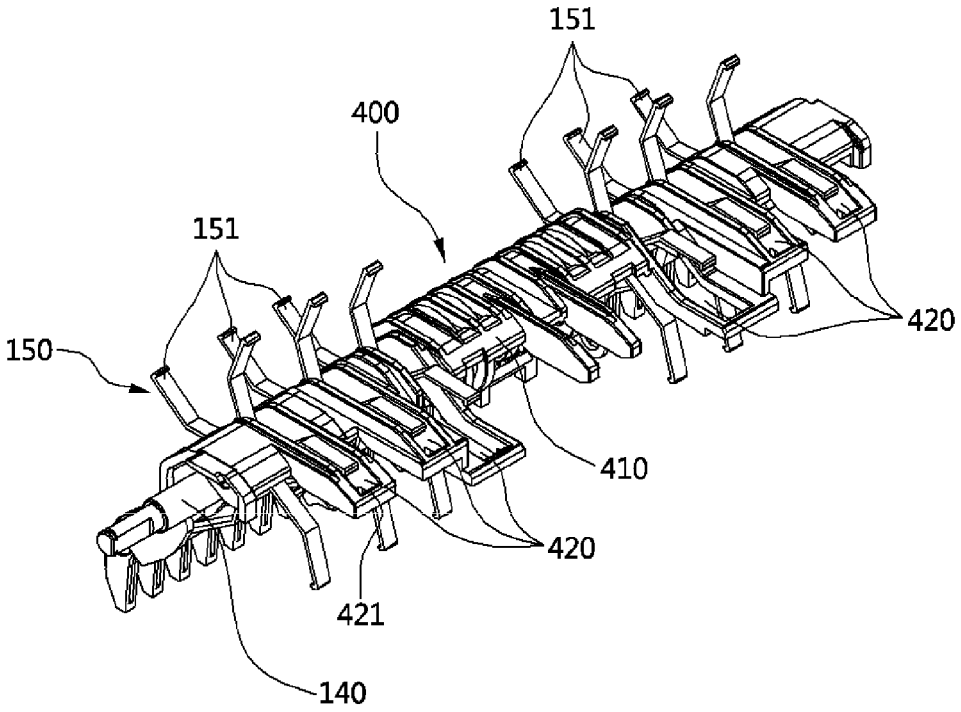
FIG. 6 is a perspective view illustrating a guide unit and a sheet roller.

Referring to FIGS. 5 and 6, a guide unit 400 which is connected to a bottom surface of the bill-stacking space S and through which the sheets 151 of the sheet rollers 150 pass is provided in an upper part and one lateral part of the sheet rollers 150. An upper part of the guide unit 400 forms the bottom surface of the bill-stacking space S, and one lateral part of the guide unit 400 is connected to the returning path 160 so as to provide a returning path to the bill P.

The guide unit 400 includes a body part 410 for providing the bottom surface of the bill-stacking space S and the returning path to the bills P, and a cutout part 420 which is formed in the body part 410 and through which the sheets 151 of the sheet rollers 150 pass. The sheets 151 of the sheet rollers 150 may be controlled to hit the bills P in a state when a lower end of the bills P entering the bill-stacking space S is moved to an upper side of the guide unit 400.

Figure 7:
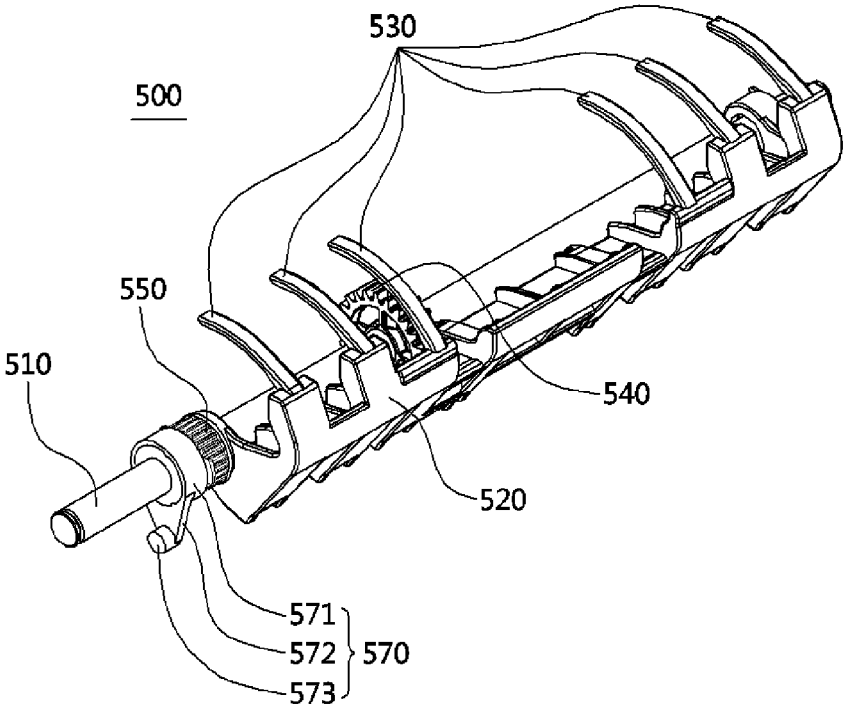
FIG. 7 is a coupled perspective view of a shutter.
Figure 8:
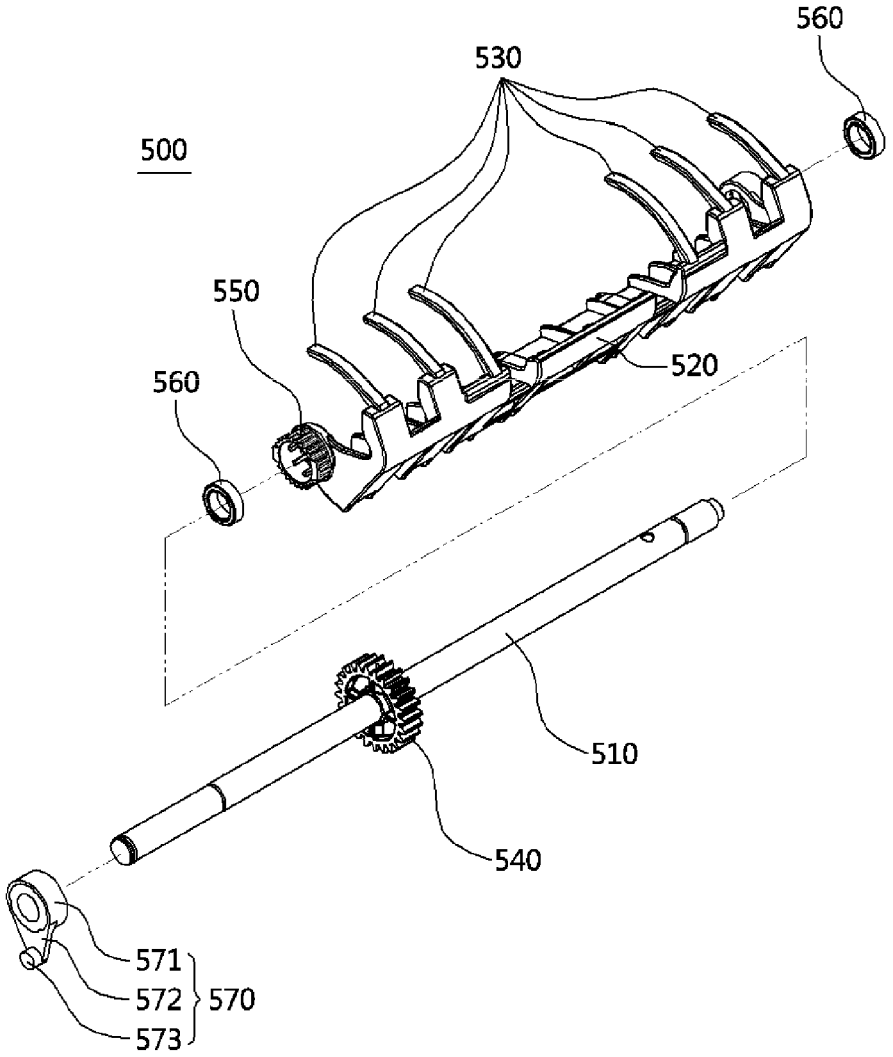
FIG. 8 is an exploded perspective view of the shutter.

Referring to FIGS. 7 and 8, a shutter 500 is provided under the guide unit 400. The shutter 500 is rotated in one direction (a clockwise direction in the drawing) to be located in a stacking position so that the sheets 151 of the sheet rollers 150 are rotatable to an upper side of the bill-stacking space S when the bills P are stacked, and the shutter is rotated in a reverse direction (a counterclockwise direction in the drawing) to be located in a separating position so that the sheets 151 are prevented from protruding to the upper side of the bill-stacking space S when the bills P are separated.

The shutter 500 includes a shutter shaft 510 that is a center of rotation of the shutter 500, a shutter body 520 which is rotated about the shutter shaft 510, a plurality of ribs 530 which are formed at positions spaced apart from each other on both upper ends of the shutter body 520 and obstruct the cutout part 420 of the guide unit 400 when the bills P are separated so as to prevent the sheets 151 of the sheet rollers 150 from passing through the cutout part 420 to protrude to the bill-stacking space S, a shutter gear 540 which is coupled to the shutter shaft 510 and is gear-coupled to a guide roller gear 131 that will be described below, a shutter pulley 550 which is integrally formed on one lateral part of the shutter body 520 and is connected to a second belt 780 which will be described below, a bearing 560 which is interposed between the shutter shaft 510 and the shutter pulley 550, and a link member 570 coupled to one lateral part of the shutter shaft 510.

The bearing 560 functions to allow relative rotation (idle rotation) between the shutter shaft 510 and the shutter pulley 550, and the detailed operation thereof will be described below.

The link member 570 includes a link body 571 coupled to one lateral part of the shutter shaft 510, an extension part 572 formed to extend to one side of the link body 571, and a protrusion 573 formed to protrude with a predetermined length from an extended end of the extension part 572.

As configurations for limiting the rotation range of the shutter 500, the bill-separating-and-stacking unit 1000 is provided with a first rotation-restriction mechanism in which the shutter 500 is rotated to be stopped at the stacking position when the bills P are stacked, and a second rotation-restriction mechanism in which the shutter 500 is rotated to be stopped at the separating position when the bills P are separated.

Referring to FIG. 3, the first rotation-restriction mechanism includes the protrusion 573 formed on one side of the shutter 500, and a latch 580 which is engaged with the protrusion 573 and stops the shutter 500 when the shutter 500 is rotated to the stacking position.

Referring to FIGS. 4 to 6, the second rotation-restriction mechanism includes a plurality of ribs 530 which are formed on the shutter 500 to obstruct the cutout part 420 of the guide unit 400 when the bills P are separated, and one lateral part 421 of the cutout part 420 with which the ribs 530 are engaged when the bills are separated.

Figure 2:
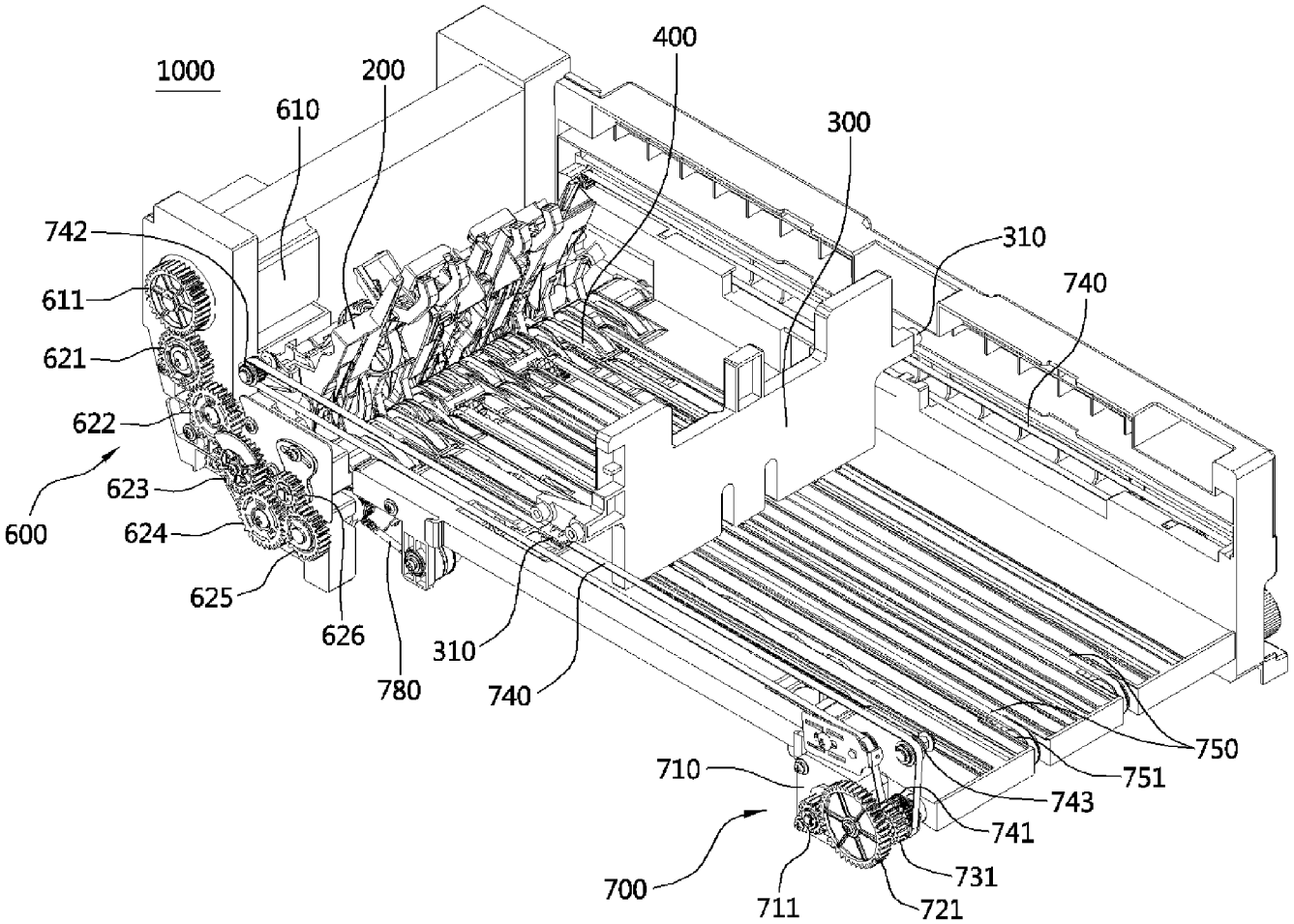
FIG. 2 is a perspective view illustrating an internal structure of a bill-separating-and-stacking unit according to one embodiment of the present invention.
Figure 9:
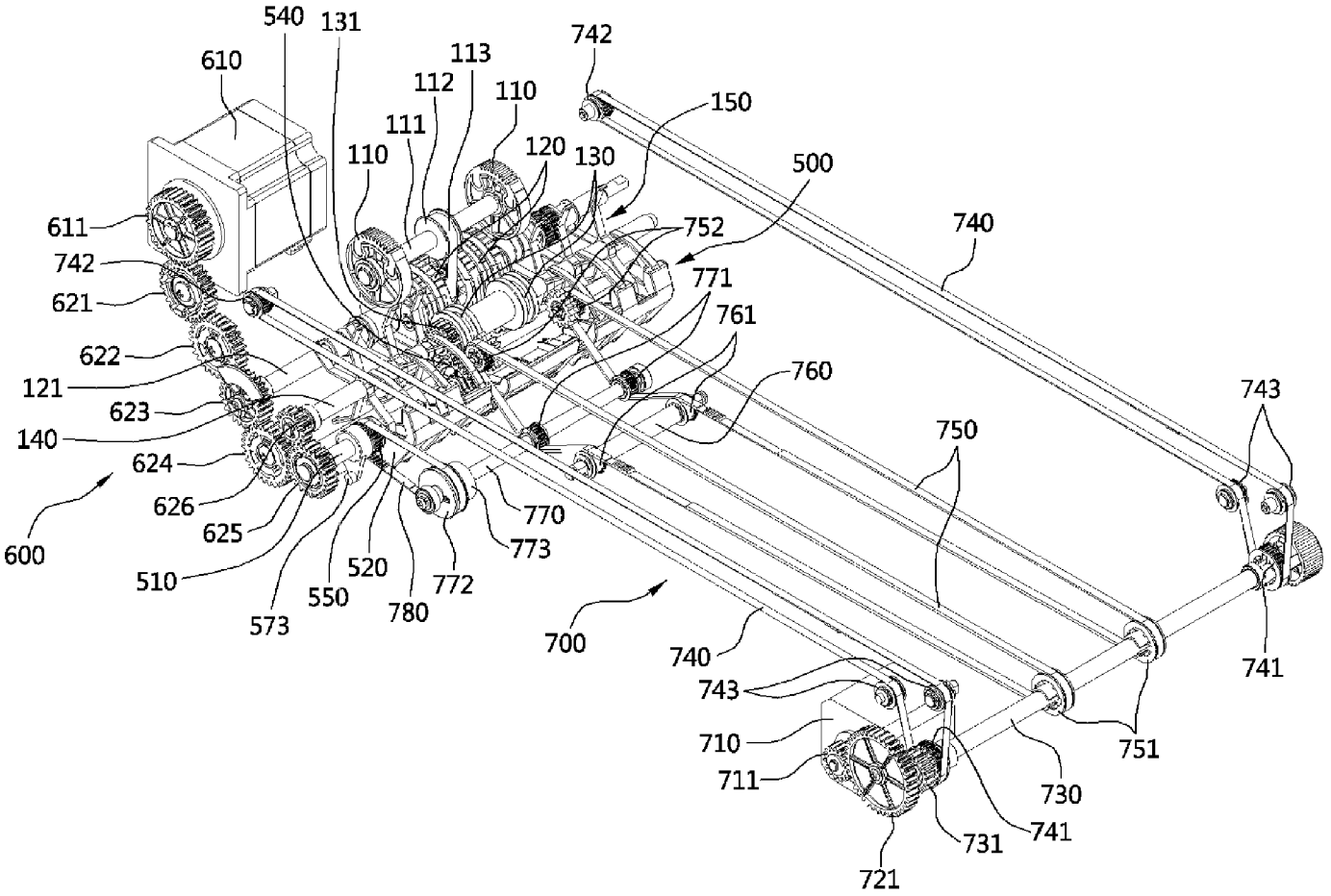
FIG. 9 is a perspective view illustrating a separating-and-stacking-mechanism driving unit and a push plate and shutter driving unit provided in the bill-separating-and-stacking unit according to one embodiment of the present invention.
Figure 10:
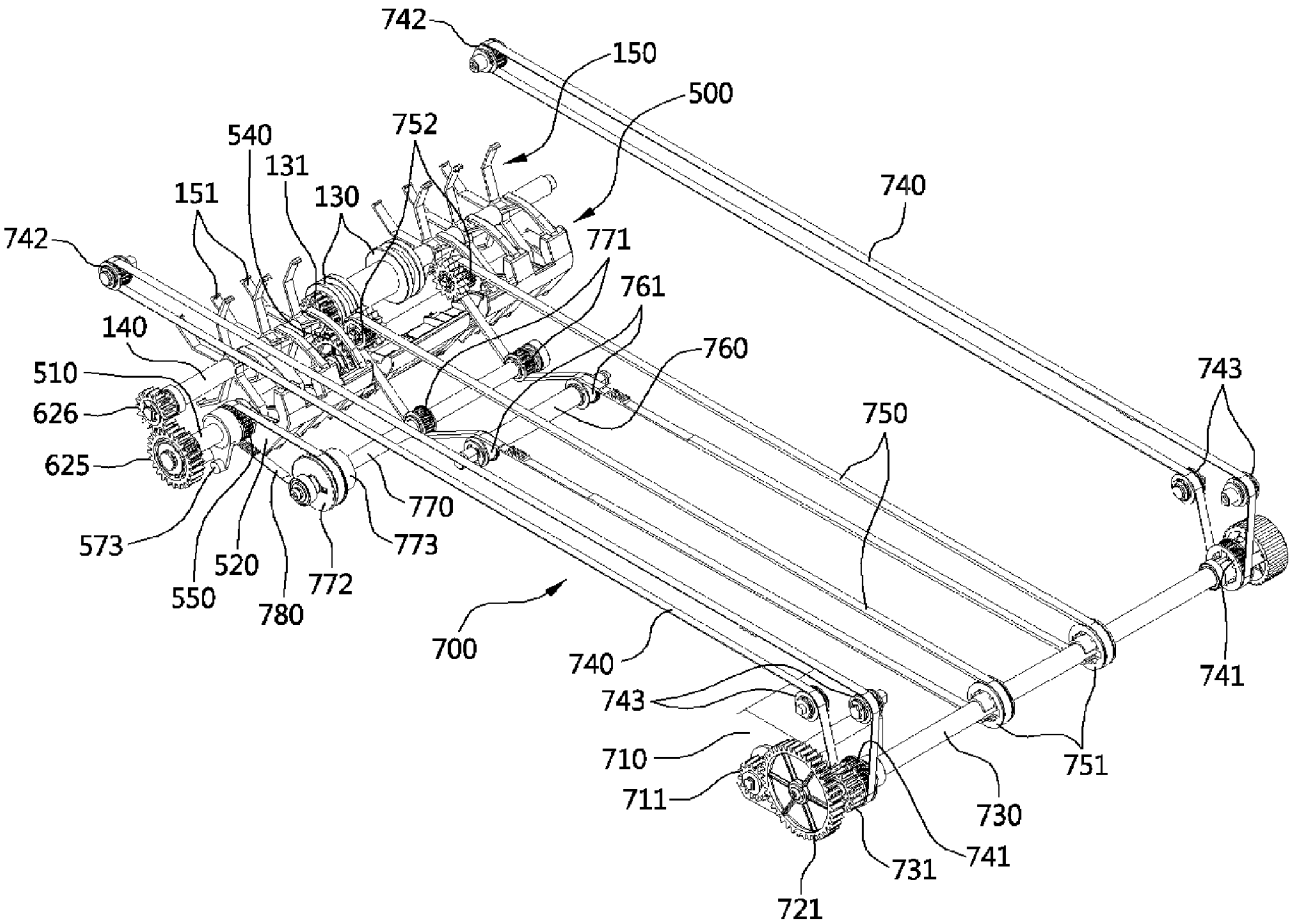
FIG. 10 is a perspective view when the push plate and shutter driving unit shown in FIG. 9 is separated.

Referring to FIGS. 2, 9 and 10, a power-transmission structure of the bill-separating-and-stacking unit 1000 according to the present invention will be described below.

The bill-separating-and-stacking unit 1000 according to the present invention includes a separating-and-stacking-mechanism driving unit 600 and a push-plate-and-shutter driving unit 700.

First of all, configurations and operations of the separating-and-stacking-mechanism driving unit 600 will be described.

The separating-and-stacking-mechanism driving unit 600 includes, as configurations for interlocking and driving the pickup roller 110, the feed roller 120, the guide roller 130, and the sheet roller 150 which together constitute the separating-and-stacking mechanism 100, a separating-and-stacking mechanism driving motor 610, a pinion gear 611 coupled to a motor shaft of the driving motor 610, and a first gear 621, a second gear 622, a third gear 623, a fourth gear 624, a fifth gear 625, and a sixth gear 626 that are sequentially gear-coupled to each other from the pinion gear 611.

The third gear 623 is coupled to one lateral part of a feed roller shaft 121 to which the feed roller 120 is coupled so as to transmit power to the feed roller shaft 121.

The fifth gear 625 is coupled to one lateral part of the shutter shaft 510 to which the shutter 500 is coupled such that the bearing 560 allows relative rotation (idle rotation) of the shutter 500, and therefore power is transmitted to the shutter shaft 510. Therefore, even when the power of the driving motor 610 is transmitted to the shutter shaft 510 to rotate the shutter shaft 510, rotational force of the shutter shaft 510 is not transmitted to the shutter 500 due to the relative rotation act of the bearing 560, and the shutter 500 is rotated and driven by power transmitted by a second belt 780 that will be described below.

The sixth gear 626 is coupled to one lateral part of a rotating shaft 140 to which the guide roller 130 and the sheet roller 150 are coupled so as to transmit power to the rotating shaft 140.

Furthermore, a pulley 112 is coupled to a pickup roller shaft 111 to which the pickup roller is coupled, and a belt 113 is coupled to the pulley 112 so that power is transmitted between the pulley 112 and a pulley (not shown) coupled to the feed roller shaft 121. Therefore, the power transmitted to the third gear 623 rotates the feed roller shaft 121 and the pickup roller shaft 111 connected to the feed roller shaft 121 with the belt 113 is also rotated in conjunction with the feed roller shaft 121.

The first gear 621 and the second gear 622 function as intermediary gears for transmitting power between the pinion gear 611 and the third gear 623, and the fourth gear 624 functions as an intermediary gear for transmitting power between the third gear 623 and the fifth gear 625.

Furthermore, a guide roller gear 131 is coupled to one side of the guide roller 130 on the rotating shaft 140, and a shutter gear 540 which is gear-coupled to the guide roller gear 131 is coupled to the shutter shaft 510.

Therefore, since each pair of gears 626, 625, 131, and 540 is mutually gear-coupled at positions spaced apart from each other on both sides of the rotating shaft 140 and the shutter shaft 510, the rotating shaft 140 and the shutter shaft 510 are rotated in conjunction with each other, and the rotating shaft 140 and the shutter shaft 510 may be located in a regular position while being supported in a parallel state.

Hereinafter, configurations and operations of the push-plate-and-shutter driving unit 700 will be described.

The push-plate-and-shutter driving unit 700 allows reciprocation of the push plate 300 and rotation of the shutter 500 to be implemented using a single driving source, which is characterized in that the power-transmission structure for driving the push plate 300 and the shutter 500 is simplified.

In terms of configurations, the push-plate-and-shutter driving unit 700 includes a push-plate-and-shutter driving motor 710, a first belt 740 which is rotated and driven by the driving motor 710 and is connected to the push plate 300, and a second belt 780 which is rotated in conjunction with the first belt 740 and is connected to the shutter 500.

Referring to FIG. 10, when the push-plate-and-shutter driving unit 700 is described in detail, the driving motor 710 is provided at a rear side of the bill-stacking space S opposite a front side of the bill-stacking space S which is provided with the separating-and-stacking mechanism 100, and a pinion gear 711 is coupled to a motor shaft of the driving motor 710. An intermediary gear 721 is gear-coupled to the pinion gear 711, and a connection gear 731 which is coupled to one lateral part of a connection shaft 730 is gear-coupled to the intermediary gear 721. A first pulley 741 around which one lateral part of the first belt 740 is wound is coupled to the connection shaft 730 on one side of the connection gear 731, and a pair of rollers 743 for switching a direction of the first belt 740 are provided on an upper side of the first pulley 741. A second pulley 742, around which the other lateral part of the first belt 740 is wound, is provided at the front side of the bill-stacking space S.

The first pulley 741 is coupled to both lateral parts of the connection shaft 730, and the rollers 743 and the second pulley 742 are provided at both lateral part of the bill-stacking space S. The coupling units 310 provided at both lateral parts of the push plate 300 are coupled to a pair of the first belts 740 provided on both sides of the bill-separating-and-stacking unit as shown in FIG. 2.

Therefore, when the first belt 740 is rotated by driving of the driving motor 710, the push plate 300 moves forward or backward in the rotation direction of the first belt 740.

A pair of first intermediary pulleys 751 are coupled to positions spaced apart from each other on both sides in the middle part of the connection shaft 730, and one lateral part of a pair of power-transmission belts 750 is wound around the first intermediary pulleys 751. Furthermore, a pair of second intermediary pulleys 752 are provided in the front side of the bill-stacking space S at positions opposite the first intermediary pulleys 751, and the other lateral part of the pair of power-transmission belts 750 is wound around the second intermediary pulleys 752.

As a configuration for applying a certain tension to the power-transmission belts 750, a pair of tension rollers 761 coupled to a tension shaft 760 are in contact with a middle part of the power-transmission belts 750.

A power-transmission shaft 770 parallel to the tension shaft 760 is provided in front of the tension shaft 760, and a pair of power-transmission pulleys 771 around which the pair of power-transmission belts 750 are wound is coupled to the power-transmission shaft 770. Therefore, rotational force of the power-transmission belts 750 is transmitted to the power-transmission shaft 770 through the power-transmission pulleys 771 so that the power-transmission shaft 770 is rotated. A torque limiter 773 is coupled to one side of the power-transmission shaft 770, and a shutter-connecting pulley 772 is coupled to an outer side of the torque limiter 773.

One lateral part of the second belt 780 is wound around the shutter-connecting pulley 772, and the other lateral part of the second belt 780 is wound around the shutter pulley 550. The shutter pulley 550 is integrally formed at the one lateral part of the shutter body 520.

When a torque exceeding a preset threshold value is applied, a slip occurs between the shutter-connecting pulley 772 and the torque limiter 773 so that the torque limiter 773 functions to block power transmission. When the shutter 500 is rotated to the stacking position to be stopped by the first rotation-restriction mechanism or when the shutter 500 is rotated to the separating position to be stopped by the second restriction mechanism, the torque limiter 773 blocks power of the first belt 740 from being transmitted to the second belt 780 based on operation of the torque limiter 773 even when the first belt 740 is driven. Accordingly, the shutter 500 can stably maintain the stopped status at the stacking position or the separating position, and excessive torque is not applied to the shutter 500 because the power transmission is blocked, and therefore damage to the shutter 500 and parts connected thereto can be prevented.

With the above configurations of the push-plate-and-shutter driving unit 700 according to the present invention, the push plate 300 and the shutter 500 are configured to be worked in conjunction with each other by the driving motor 710 which is a single driving source, the first belt 740, and the second belt 780, and therefore the power-transmission structure can be simplified by integrating driving units of the push plate 300 and the shutter 500 into a single unit.

Therefore, according to a bill-separating-and-stacking unit of the present invention, a push-plate-and-shutter driving unit is provided with a single driving motor for driving a push plate in conjunction with a shutter, a first belt which is rotated and driven by the driving motor and is connected to the push plate, and a second belt which is rotated in conjunction with the first belt and is connected to the shutter, and therefore driving units of the push plate and the shutter are integrated into a single unit so that a power-transmission structure can be simplified.

Furthermore, a bill-separating-and-stacking unit of the present invention includes a first rotation-restriction mechanism in which a shutter is rotated to be stopped at a stacking position when bills are stacked so as to prevent intervention between the shutter and sheets of a sheet roller so that the bills can be stacked in a smooth manner, and a second rotation-restriction mechanism in which the shutter is rotated to be stopped at a separating position when the bills are separated so as to prevent intervention between the separated bills and the sheets of the sheet roller so that the bills can be separated in a smooth manner.

Furthermore, when a shutter is stopped at a stacking position or a separating position, a torque limiter is provided to block power of a first belt from being transmitted to a second belt so that the shutter can stably maintain a stopped status at the stacking position or the separating position even when a push plate moves backward and forward, and therefore damage to the shutter can be prevented.

Furthermore, a bill-stacking-and-separating unit of the present invention includes a single driving motor for driving a pickup roller, a feed roller, a guide roller, and a sheet roller consisting of a separating-and-stacking mechanism, and a separating-and-stacking-mechanism driving unit including a plurality of gears that are gear-coupled to each other, and therefore a power-transmission structure of the separating-and-stacking mechanism can be simplified.

Furthermore, a pair of gears are mutually gear-coupled at positions spaced apart from each other on both sides of a rotating shaft coupled to a guide roller and a sheet roller and a shutter shaft coupled to a shutter so that the rotating shaft and the shutter shaft are rotated in conjunction with each other, and therefore the rotating shaft and the shutter shaft can be located at a regular position while being supported in parallel status.

Furthermore, a bearing is interposed between a shutter shaft and a shutter pulley so that the shutter is rotated and driven by driving power of a push-plate-and-shutter driving unit without being influenced by driving power of a separating-and-stacking-mechanism driving unit, and therefore the shutter can be driven accurately.

As described above, the invention is not limited to the above-described embodiments, it should be understood that various modified embodiments may be made by those skilled in the art therein without departing from the spirit and scope of embodiments as defined by the appended claims, and such modified embodiments are within the scope of the present invention.

What is claimed is:

1. A bill-separating-and-stacking unit, comprising:

a sheet roller configured to hit bills entering a bill-stacking space with a sheet, which is rotated, and configured to guide the bills to be stacked;

a push plate configured to perform reciprocation and support the bills which are stacked in the bill-stacking space;

a shutter which is rotated in one direction to be located in a stacking position so that the sheet of the sheet roller is rotatable to an upper side of the bill-stacking space when the bills are stacked, and is rotated in a direction opposite the one direction to be located in a separating position so that the sheet is prevented from protruding to the upper side of the bill-stacking space when the bills are separated; and a push-plate-and-shutter driving unit having a single driving source such that the push plate is worked in conjunction with the shutter, wherein the push-plate-and-shutter driving unit includes:

a push-plate-and-shutter driving motor, a first belt which is rotated and driven by the push-plate-and-shutter driving motor and is connected to the push plate, a second belt which is rotated in conjunction with the first belt and is connected to the shutter, and a power-transmission belt configured to transmit power between the first belt and the second belt.

2. The bill-separating-and-stacking unit of claim 1, further comprising:

a first rotation-restriction mechanism in which the shutter is rotated to be stopped at the stacking position when the bills are stacked; and a second rotation-restriction mechanism in which the shutter is rotated to be stopped at the separating position when the bills are separated.

3. The bill-separating-and-stacking unit of claim 2, wherein the first rotation-restriction mechanism includes a protrusion formed on one side of the shutter, and a latch by which the shutter is engaged with the protrusion and stopped when the shutter is rotated to the stacking position.

4. The bill-separating-and-stacking unit of claim 2, further comprising a guide unit which is connected to a bottom surface of the bill-stacking space and in which a cutout part through which the sheet of the sheet roller pass is formed, wherein the second rotation-restriction mechanism includes a rib which is formed on the shutter to obstruct the cutout part when the bills are separated, and one lateral part of the cutout part with which the rib is engaged when the bills are separated.

5. The bill-separating-and-stacking unit of claim 2, further comprising a torque limiter configured to block power of the first belt from being transmitted to the second belt when the shutter is rotated to the stacking position and is stopped by the first rotation-restriction mechanism or when the shutter is rotated to the separating position and is stopped by the second rotation-restriction mechanism.

6. The bill-separating-and-stacking unit of claim 1, further comprising a separating-and-stacking-mechanism driving unit configured to drive a separating-and-stacking mechanism, wherein the separating-and-stacking mechanism, in which bills returned along a returning path are stacked in the bill-stacking space or the bills stored in the bill-stacking space are separated and returned, is provided at a bill inlet side of the bill-stacking space, and includes:

a pickup roller configured to separate each of the bills stored in the bill-stacking space;

a feed roller which is provided under the pickup roller and applies transmission power to the bills;

a guide roller which is circumscribed about the feed roller and prevents the bills from being separated in two bills; and the sheet roller.

7. The bill-separating-and-stacking unit of claim 6, wherein the separating-and-stacking-mechanism driving unit includes:

a separating-and-stacking mechanism driving motor; and a plurality of gears which are rotated by the separating-and-stacking mechanism driving motor and are gear-coupled to each other such that a pickup roller shaft coupled to the pickup roller, a feed roller shaft coupled to the feed roller, a rotating shaft to which the guide roller and the sheet roller are coupled, and a shutter shaft coupled to the shutter are rotated in conjunction with each other.

8. The bill-separating-and-stacking unit of claim 7, wherein:

a pair of gears are mutually gear-coupled at positions spaced apart from each other on both sides of the rotating shaft and the shutter shaft so that the rotating shaft and the shutter shaft are rotated in conjunction with each other;

a shutter pulley connected to the second belt is provided on one side of the shutter; and a bearing is interposed between the shutter shaft and the shutter pulley so that the shutter is rotated and driven by driving power of the push-plate-and-shutter driving unit without being influenced by driving power of the separating-and-stacking-mechanism driving unit.

* * * * *